US006640558B1

(12) United States Patent
Zenisek

(10) Patent No.: US 6,640,558 B1
(45) Date of Patent: Nov. 4, 2003

(54) ICE CANDLE METHOD AND APPARATUS

(76) Inventor: Michael D. Zenisek, 4533 Abbott Ave. South, Minneapolis, MN (US) 55410

( * ) Notice: Subject to any disclaimer, the term of this patent is extended or adjusted under 35 U.S.C. 154(b) by 0 days.

(21) Appl. No.: 09/619,772

(22) Filed: Jul. 20, 2000

Related U.S. Application Data

(60) Provisional application No. 60/144,762, filed on Jul. 20, 1999.

(51) Int. Cl.[7] ..... F25C 1/04

(52) U.S. Cl. ..... 62/66; 62/340; 62/1; 431/289

(58) Field of Search ..... 62/1, 66, 340; 431/289, 291; 249/117, 144; 220/608, 773

(56) References Cited

U.S. PATENT DOCUMENTS 1,123,537 A * 1/1915 Huizer ..... 62/1
2,952,133 A * 9/1960 Miller ..... 62/1
3,065,606 A * 11/1962 Reynolds ..... 62/1
4,550,575 A * 11/1985 DeGaynor ..... 62/1
4,625,518 A * 12/1986 Freedman ..... 62/1
5,250,315 A * 10/1993 Loew et al. ..... 62/1
5,419,856 A * 5/1995 Shaw ..... 62/1
5,941,381 A * 8/1999 James ..... 206/229
6,315,433 B1 * 11/2001 Cavello ..... 362/318

* cited by examiner

*Primary Examiner*—William E. Tapolcai
(74) *Attorney, Agent, or Firm*—Schwegman, Lundberg, Woessner & Kluth, P.A.

(57) ABSTRACT

An ice candle mold apparatus and method for forming an ice candle holder is disclosed wherein the ice candle holder includes a frozen container hereto. The ice candle holder includes integral frozen sidewalls and bottom. The ice candle holder to be formed with a one-piece ice candle mold with multiple feet and optional C-shaped handle with the ends embedded in the mold's exterior sidewalls.

3 Claims, 5 Drawing Sheets

ICE CANDLE METHOD AND APPARATUS

This application claims the benefit of Provisional Application No. 60/144,762 filed Jul. 20, 1999.

TECHNICAL FIELD OF THE INVENTION

The present invention relates generally to the field of frozen ice products, molds or sculptures, and,more particularly, an ice candle holder comprised of molded, frozen ice sidewalls and bottom to be formed with a one-piece ice candle holder mold.

BACKGROUND OF THE INVENTION

Seasonal outdoor decorating with lights, ornaments, displays, etc has always been a big part of winter holidays i.e. x-mas, etc. Homemade Ice candle holders have embellished the walkways and entryways of homes during the cold winter months, the flickering candles within add light and a sense of inviting warmth to a guest or passerby. Unfortunately, they have had to be created in a multi-staged, multi-freezing process. To far as is known to the inventor/applicant no one to date has successfully developed a mold to make ice candle holders. My invention of The Ice Candle Holder Mold relates to, and addresses the inherent obstacles and difficulties encountered in the creation of an ice candle holder.

SUMMARY OF THE INVENTION

The Ice Candle Holder Mold is a one-piece, re-useable mold dedicated and designed exclusively to simplify and expedite the creation of Ice Candle Holders. It is based on a simple: freeze, remove, display and repeat process.

DETAILED DESCRIPTION OF THE INVENTION

Figure 1:
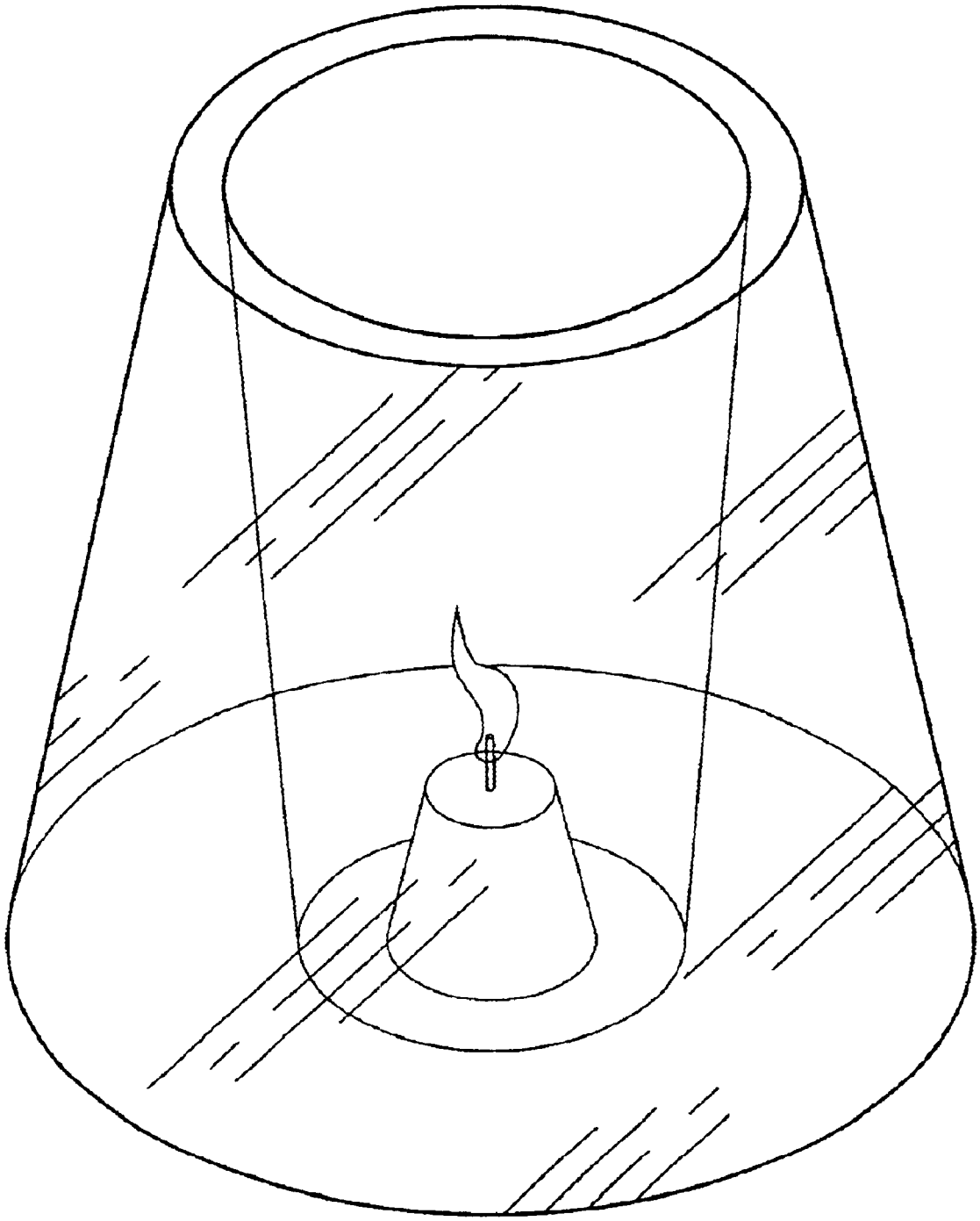
FIG. 1 is a perspective view of an ice candle holder constructed in accordance with the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 an ice candle holder constructed in accordance with the present invention. The ice candle holder comprises generally a frozen container having a relatively thick frozen bottom and an integral, upwardly extending sidewall defining a hollow interior space.

Figure 2:
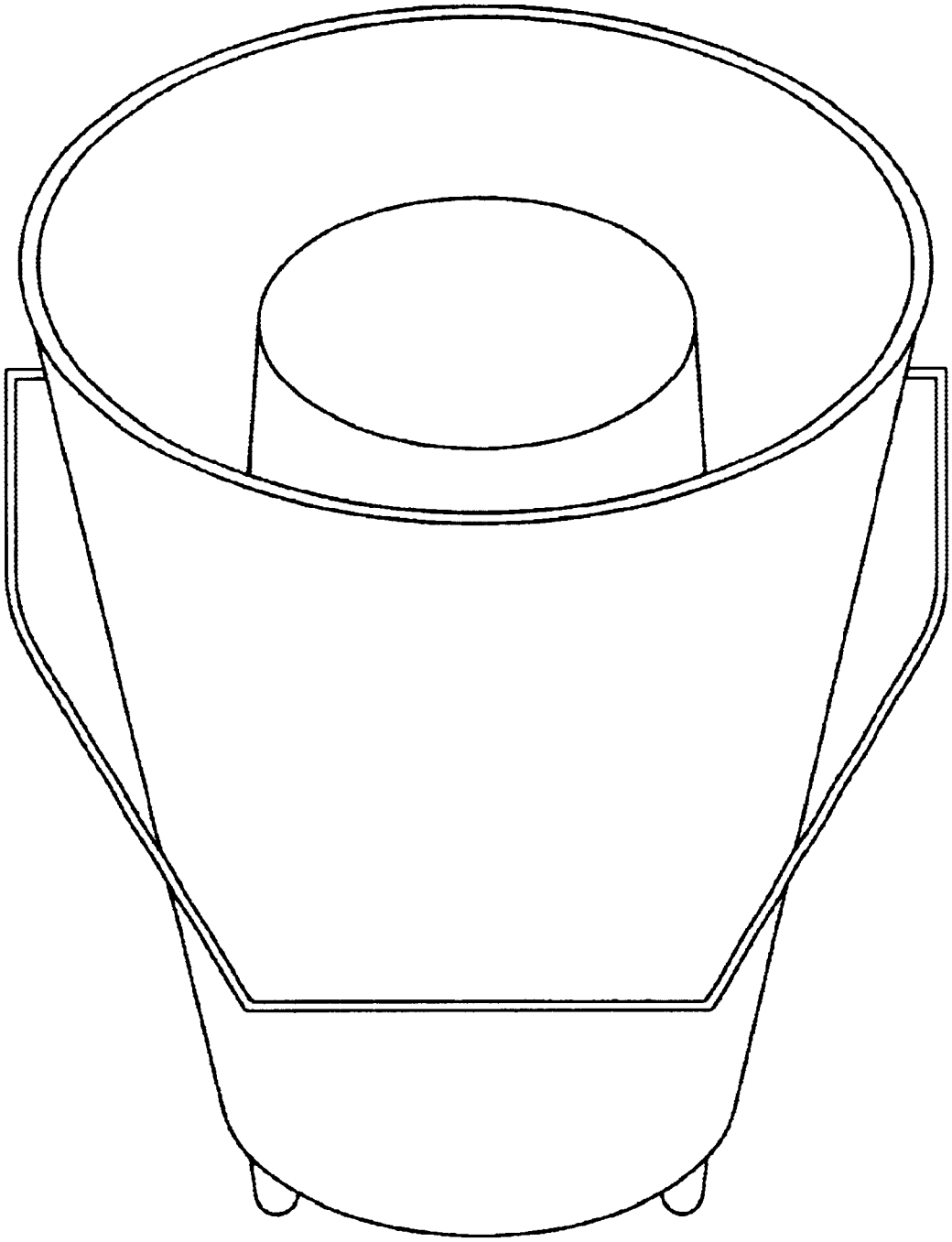
FIG. 2 is a perspective view of an ice candle mold shown in accordance with the present invention.
Figure 3:
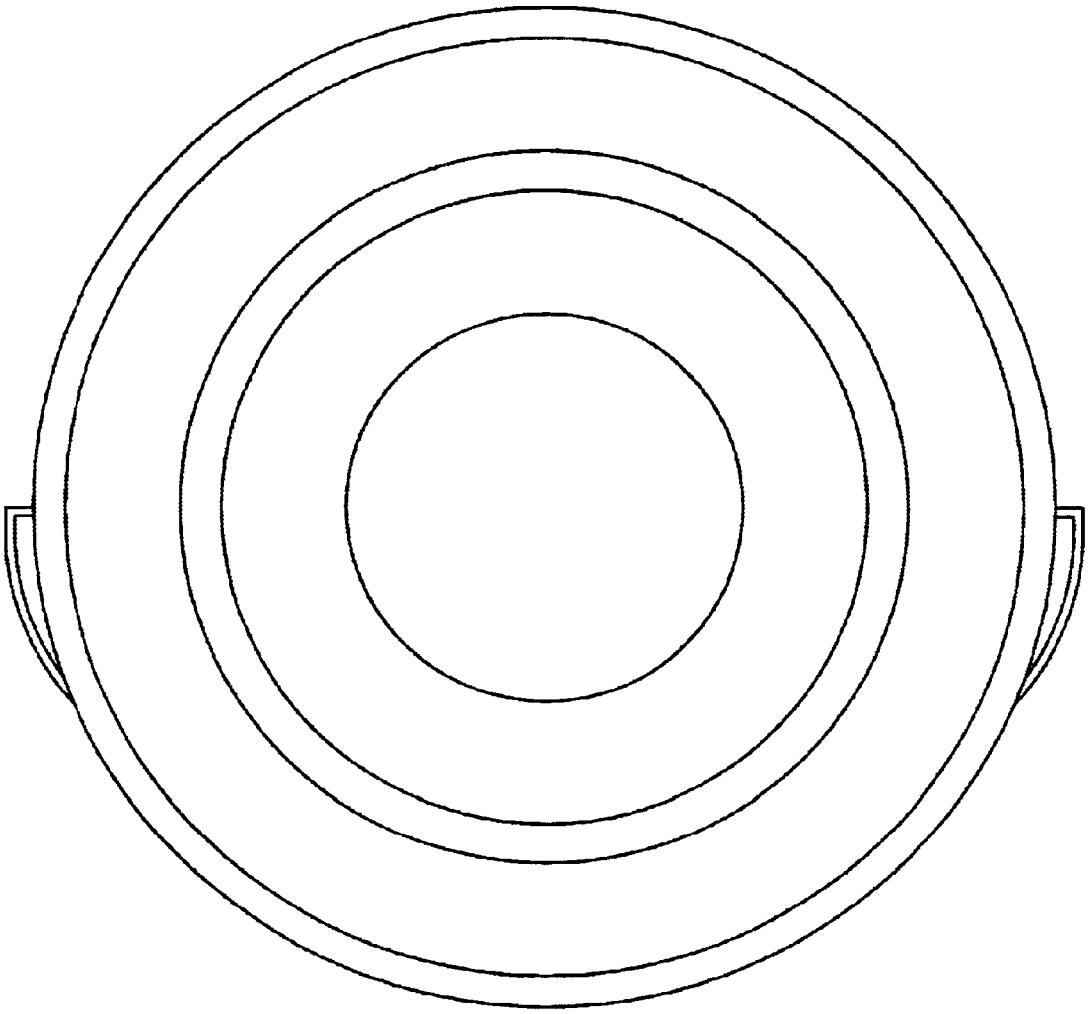
FIG. 3 is a top plan view of the ice candle mold
Figure 4:
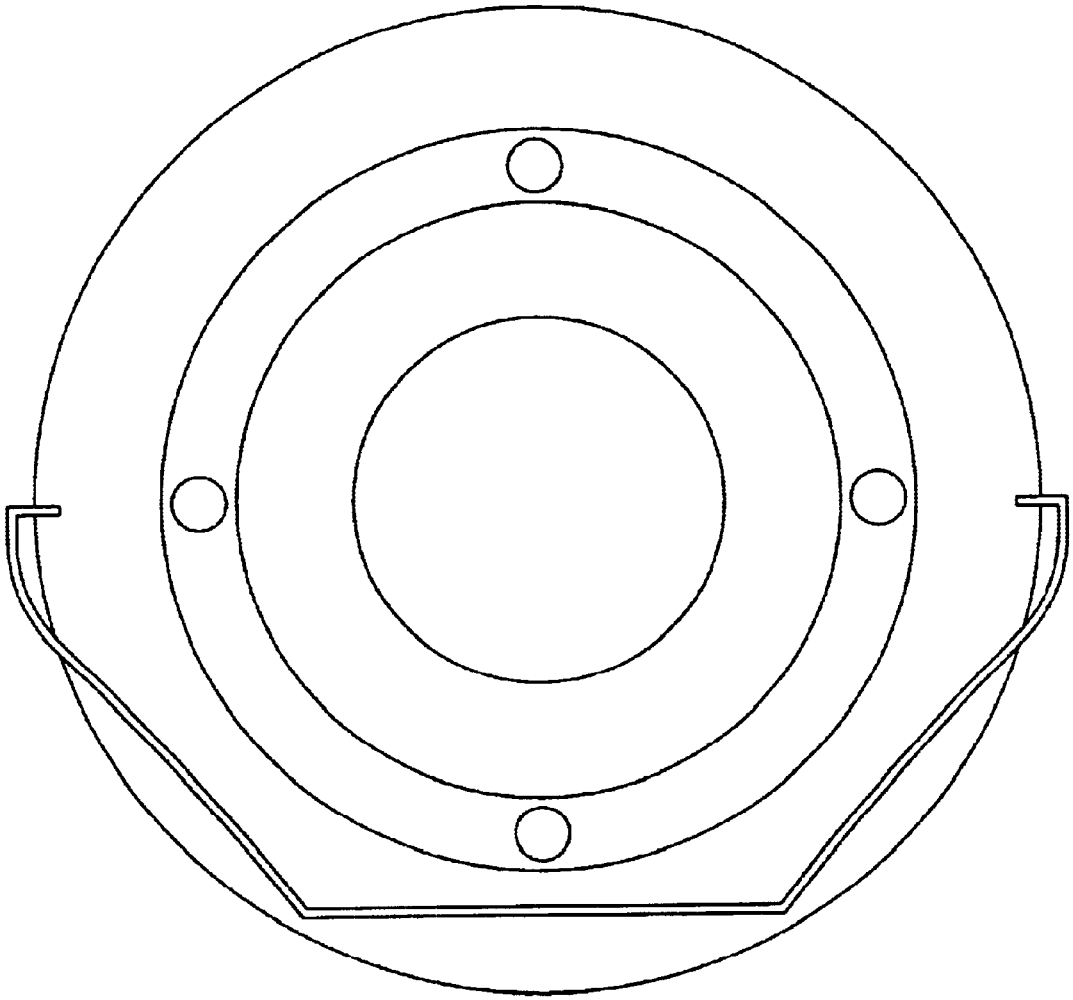
FIG. 4 is a bottom plan view of the ice candle mold
Figure 5:
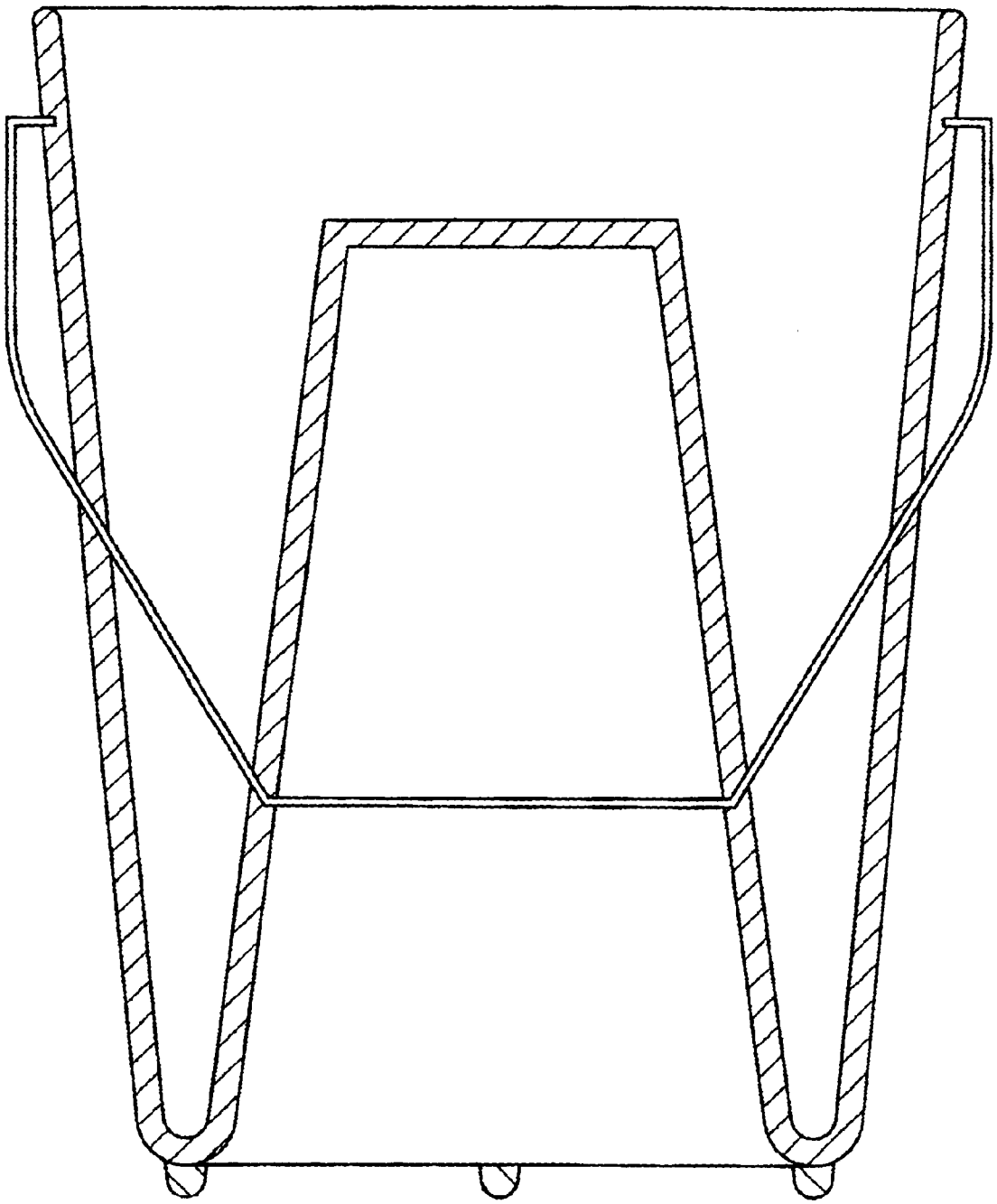
FIG. 5 is a cross sectional view showing a one-piece ice candle mold of suitable configuration for forming the frozen container portion of the ice candle holder.

FIG. 2 may be employed for this purpose. As shown, the one-piece mold comprises generally an open top to receive therein water or other liquid—in liquid form prior to freezing and to discharge or release there from the frozen container upon completion of the freezing operation.

Still referring to FIG. 2., the one piece mold is formed with a generally cylindrical annular (circular or multisided) area of suitable configuration to form the sidewalls of the frozen container. A solid base area communicated with the annular area to thereby provide the integral bottom and sidewall of the frozen container as above discussed. A shaped interior baffle wall is provided of generally hollow, cylindrical construction in the mold to displace liquid and provide a central cavity to form the corresponding hollow interior of the ice candle holder. Of course, the configurations of the annular areas and the solid base area of the ice candle holder mold may be varied in dimensions, shape and size in known manner in order to form the desired end shape and size of the ice candle holder. For sake of clarity a rough example follows—( a standard five gallon bucket holds five gallons of liquid. An ice candle holder mold of same exterior dimensions would, due to the interior baffle in the mold, displace roughly half of the liquid, or two and one-half gallons)

Still referring to FIG. 2., the one piece mold has multiple protrusions or feet incorporated on the exterior bottom of the mold to allow subfreezing air to circulate under and into the cavity beneath the mold thus expediting the freezing process of liquid contents. In contrast, after the freezing process is complete, the ice candle holder mold and frozen contents can be introduced to a warmer environment. The protrusions or feet will allow the circulation of warmer air on the exterior of the mold, warming the mold uniformly. This will assist greatly with the release and removal of the frozen product from the mold. A C-shaped handle with ends embedded in the mold's exterior sidewalls simplifies transportation of mold and contents and ergonomically assists in the inversion and extraction of finished product.

In use, the one-piece mold is positioned with the open top facing upwardly. After the mold is filled with water or other liquid through the open top thereof, it is then placed in known manner in a freezing atmosphere or environment (not shown) such as environmental conditions conducive to freezing, or a conventional freezer and left or held therein for a sufficient period of time to solidify and freeze the liquid contents (not shown) thereof. After the liquid contents have been properly frozen, the frozen product is released from the mold in known manner. Upon release, a candle or other luminary device can then be introduced into the frozen container and ignited or displayed in known manner.

The finished ice candle holder being solely comprised of frozen ice shall only remain in its intended form in an atmosphere or environment with sustained temperatures below the point of freezing (or preferred); the one-piece mold can be taken from the freezing environment and introduced to a warmer environment long enough to thaw the frozen bond allowing the frozen product to then be more easily released from the mold in known manner.

What is claimed is:

1. A method of forming an ice candle holder having one or more frozen sidewalls and bottom and a hollow interior, comprising:

fabricating a mold having an open first end, at least one sidewall, a closed opposite end and a shaped interior baffle;

attaching a handle to at least two points on the mold, generally proximate the open first end;

positioning the open first end upwardly and filling the mold with a freezable liquid;

freezing the liquid within the mold to form the ice candle holder;

releasing the ice candle holder from the mold.

2. The method of claim 1 further including rotating the frozen container through one hundred and eighty degrees from its orientation when formed and facing a hollow interior of the ice candle holder upwardly prior to use.

3. A method of forming an ice candle holder having a container with an integral frozen bottom and sidewalls adapted for inserting a candle or luminary device on the bottom within the sidewalls comprising:

fabricating a mold used to form the container, the mold having a closed bottom and upwardly extending sidewalls;

fabricating a number of protrusions attached to the closed bottom;

filling the mold with a freezable liquid and freezing the liquid within the mold to form the container; and removing the container from the mold.

* * * * *